US006041871A

United States Patent [19]

Defty

[11] Patent Number: 6,041,871

[45] Date of Patent: Mar. 28, 2000

[54] BULLDOZER PUSH ARM CONTROL ASSEMBLY AND METHOD

[76] Inventor: Spencer Defty, 1403 Tyler Dr., Woodland, Calif. 95776

[21] Appl. No.: 08/962,981

[22] Filed: Oct. 30, 1997

[51] Int. Cl.[7] ..... E02F 3/76

[52] U.S. Cl. ..... 172/817; 172/827; 172/776

[58] Field of Search ..... 172/811, 776, 172/812, 816, 817, 823, 824, 826, 827, 828, 272, 245

[56] References Cited

U.S. PATENT DOCUMENTS

| | | | |
|---|---|---|---|
| 1,784,144 | 12/1930 | Kerber | 172/827 |
| 2,485,407 | 10/1949 | Peterson | 172/826 |
| 2,624,132 | 1/1953 | Henry | 37/144 |
| 2,659,572 | 11/1953 | Steer | 254/124 |
| 3,016,635 | 1/1962 | Aston | 172/811 |
| 3,395,764 | 8/1968 | Wirt | 172/826 |
| 3,628,265 | 12/1971 | Galis | 172/811 X |
| 3,662,841 | 5/1972 | Molby et al. | 172/804 |
| 3,729,844 | 5/1973 | Deglan | 172/811 X |
| 3,776,317 | 12/1973 | Royer | 172/826 X |
| 3,974,882 | 8/1976 | Eftefield | 172/826 X |
| 4,019,588 | 4/1977 | Casey | 172/827 X |
| 4,098,350 | 7/1978 | Eftefield | 172/811 X |
| 4,135,584 | 1/1979 | Smith et al. | 172/804 |
| 4,147,218 | 4/1979 | Stedman | 172/803 |
| 4,153,117 | 5/1979 | Freese | 172/809 |
| 4,286,674 | 9/1981 | Noble et al. | 172/811 |
| 5,154,241 | 10/1992 | Comer et al. | 172/811 X |

FOREIGN PATENT DOCUMENTS

| | | | |
|---|---|---|---|
| 53702 | 3/1977 | U.S.S.R. | 172/827 |

*Primary Examiner*—Victor Batson

*Attorney, Agent, or Firm*—Flehr Hohbach Test Albritton & Herbert LLP

[57] ABSTRACT

A push arm control assembly (30, 30*a*) for use with bulldozer (10) having blade (12) removably mounted to a pair of laterally displaceable push arms (14) on opposite sides of the bulldozer.

The push arm control assembly includes at least one elongated, relatively lightweight, control member (32, 56, 59) having a length dimension substantially spanning the distance between push arms (14) and having a strength sufficient to enable lifting of push arms (14) as a unit. A pair of arm coupling assemblies (33) are provided on control member (30, 30*a*) and are adapted for coupling to each of push arms (14) for manipulation of the push arms (14) as a unit. In the preferred form, the control arm assembly (30, 30*a*) positions the push arms (14) a distance less than the lateral distance between push arms (14) when push arms (14) are coupled to blade (12). Thus, upon removal of blade (12) from push arms (14) and displacement of push arms (14) inwardly toward each other, control member (30, 30*a*) can be coupled to push arms (14) by arm coupling assemblies (33) for lifting and controlled positioning of push arms (14) for transport of the bulldozer.

A method of enabling transport of bulldozer (10) also is disclosed.

14 Claims, 7 Drawing Sheets

BULLDOZER PUSH ARM CONTROL ASSEMBLY AND METHOD

TECHNICAL FIELD

The present invention relates to bulldozers and more particularly to systems for transporting bulldozers when the front blade of the bulldozer is removed.

BACKGROUND OF THE INVENTION

Transporting bulldozers on the backs of low flatbed trucks has proven difficult especially for the larger bulldozer designs (for example, a Caterpiller Tractor, Model D-9 or larger) in which the blade of the bulldozer is of a width such that it protrudes substantially beyond the sides of the flatbed truck. In most states of the United States, to be legally driven on the back of a low flatbed truck, (ie: "street legal"), the sides of the bulldozer must typically not extend to a width greater than permitted under state and/or federal highway regulations.

Consequently, for large bulldozers, the blade must be disconnected from the bulldozer when the bulldozer is placed on the bed of the flatbed truck so that the bulldozer can be made street legal. The bulldozer blade is typically rotated by 90° and placed either beside the bulldozer on the same flatbed truck or alternatively it is placed on a separate truck.

The removal of the blade from the bulldozer is no easy task. Often, such blades weigh up to 10,000 pounds, and the push arms, which also must be removed, can weigh 5,000 pounds or more. Thus, a crane or boom truck is required to lift and to move the blade and push arms while they are being disassembled from the bulldozer. This process is very time consuming, often requiring two men to work for as long as eight hours in order to ready the bulldozer for transport.

Another major problem with removing the blade and push arms from the bulldozer is that the hydraulic lift cylinders, which support and control the movement of the blade and push arms, typically will be unsupported and uncontrollable when detached from the blade. When the bulldozer blade is detached, the hydraulic cylinders can freely articulate and the pistons extend from the hydraulic cylinders such that the hydraulic assembly must be secured for transport. Accordingly, the blade hydraulic system typically is at least partially disassembled as part of the transport process.

A variety of devices do exist for mounting and manipulating the orientation of bulldozer blades. None of these devices, however, are adapted to hold the bulldozer push arms inwardly at an elevated position while simultaneously holding together the hydraulic lift cylinder assembly attached to the back of a bulldozer blade when the blade has been removed.

For example, U.S. Pat. No. 1,784,144 to Kerber discloses a bulldozer blade which is designed not to interfere with the use of a rear draw bar. U.S. Pat. No. 2,624,132 to Henry discloses a bulldozer attachment for tractors which is designed to equalize the vertical movement of the bulldozer blade along its length regardless of the forces which may be exerted on the blade by its contact with the ground. U.S. Pat. No. 2,659,572 to Steer discloses a tractor lifting apparatus which is attached to the front of the tractor thereby providing a low center of gravity enabling more effective pushing. U.S. Pat. No. 3,662,841 to Mobley, et al. discloses a bulldozer blade mounting system having an easily adjustable pitch. U.S. Pat. No. 4,135,584 to Smith, et al. discloses a bulldozer blade stabilizing linkage which prevents side forces exerted on the blade from shifting the blade by a distance whereby the lift linkages would come into contact with the tracks of the bulldozer. U.S. Pat. No. 4,147,218 to Stedman discloses a bulldozer attachment for a four-tracked tractor having a pair of push arms extending between respective pairs of track assemblies. U.S. Pat. No. 4,153,117 to Freese discloses a three point attachment support for a cushioned bulldozer blade. Lastly, U.S. Pat. No. 4,286,674 to Noble, et al. discloses a replaceable bearing assembly for use at the connection point between a bulldozer push arm and the side of the bulldozer. Unfortunately, none of these existing systems are adapted to solve the present problems which occur when the front blade is removed from a bulldozer in order to enable transport.

OBJECTS OF THE INVENTION

Accordingly, it is an object of the present invention to provide a system which facilitates the removal of the blade of a bulldozer for transport on the back of a truck, such as a low flatbed truck.

It is another object to provide a system for decreasing the width of a bulldozer to a street legal size after the blade of the bulldozer has been removed.

It is another object of the present invention to provide a system for eliminating the need to disassemble hydraulic lift cylinders at the front of a bulldozer when they are disconnected from the bulldozer blade during removal of the bulldozer blade for transport of the bulldozer.

It is another object of the present invention to provide a system for supporting the push arms of the bulldozer in an inwardly displaced position for transport thereby eliminating the necessity for their removal and decreasing the width of the bulldozer when the blade is removed.

It is another object of the present invention to provide a system for supporting the bulldozer push arms in a manner that does not interfere with the movement of the tracks of the bulldozer when the front blade of the bulldozer has been removed so that the bulldozer can be driven onto the transport truck.

It is yet another object to provide a system for easily and automatically adjusting the angular displacement of the bulldozer push arms such that the push arms can be easily splayed outwardly or rotated inwardly relative to one another to facilitate attachment and detachment of the blade.

DISCLOSURE OF THE INVENTION

The present invention discloses a push arm control assembly for use with a bulldozer having a blade removably mounted to a pair of laterally displaceable push arms on opposite sides of the bulldozer, the control assembly comprising: (a) at least one elongated, control member having a length dimension substantially spanning the distance between the push arms and having a strength sufficient to enable lifting of the push arms; and (b) a pair of arm coupling assemblies provided on the control member and adapted for coupling to each of the push arms, the arm coupling assemblies being laterally spaced apart on the control member by a distance less than the lateral distance between the push arms when the push arms are coupled to the blade. Upon removal of the blade from the push arms and displacement of the push arms inwardly toward each other, therefore, the control member can be coupled to the push arms by the arm coupling assemblies for lifting and controlled positioning of the push arms as a unit when the blade is removed.

In one embodiment, the control member remains attached to the bulldozer push arms and is adapted to telescope to various lengths such that, at its extended position, it can easily be attached to the bulldozer blade and, at its retracted position, it supports the push arms in an inwardly displaced position for transport.

Also disclosed is the method of enabling transport of a bulldozer having a bulldozer blade and at least two push arms detachably coupled to the bulldozer blade, comprising the steps of: (a) detaching the bulldozer blade from the bulldozer push arms; (b) mounting a control assembly between the push arms; and (c) lifting the control assembly to lift the push arms thereby enabling movement of the bulldozer onto a transport vehicle. In the preferred method, the control assembly is coupled to the blade hydraulic lift assembly and the blade lift assembly is used to effect the lifting step.

A similar method is also provided wherein the mounting step is accomplished prior to the detaching step and the control assembly mounted between the push arms is formed to be telescoped between an extended position and a retracted position, thereby displacing the push arms toward or away from each other for detachment and attachment of the blade and transport of the bulldozer.

BEST MODE OF CARRYING OUT THE INVENTION

The present invention provides a system for facilitating the transportation of large bulldozers by trucks, typically, by being placed on the bed of a low-bed flatbed truck. More specifically, the present invention provides a system for narrowing the width of the bulldozer after the bulldozer front blade has been removed thus enabling the bulldozer to be of a width such that it can be legally transported on the bed of a flatbed truck. The present invention also provides the advantages of supporting the bulldozer push arms in a manner which eliminates the need for their removal and easily allows the bulldozer to be driven onto the transport truck with its front blade removed. Moreover, the present invention advantageously provides a system for using the bulldozer's hydraulic lift assemblies to control push arm positioning when the blade is detached from the bulldozer.

Figure 1:
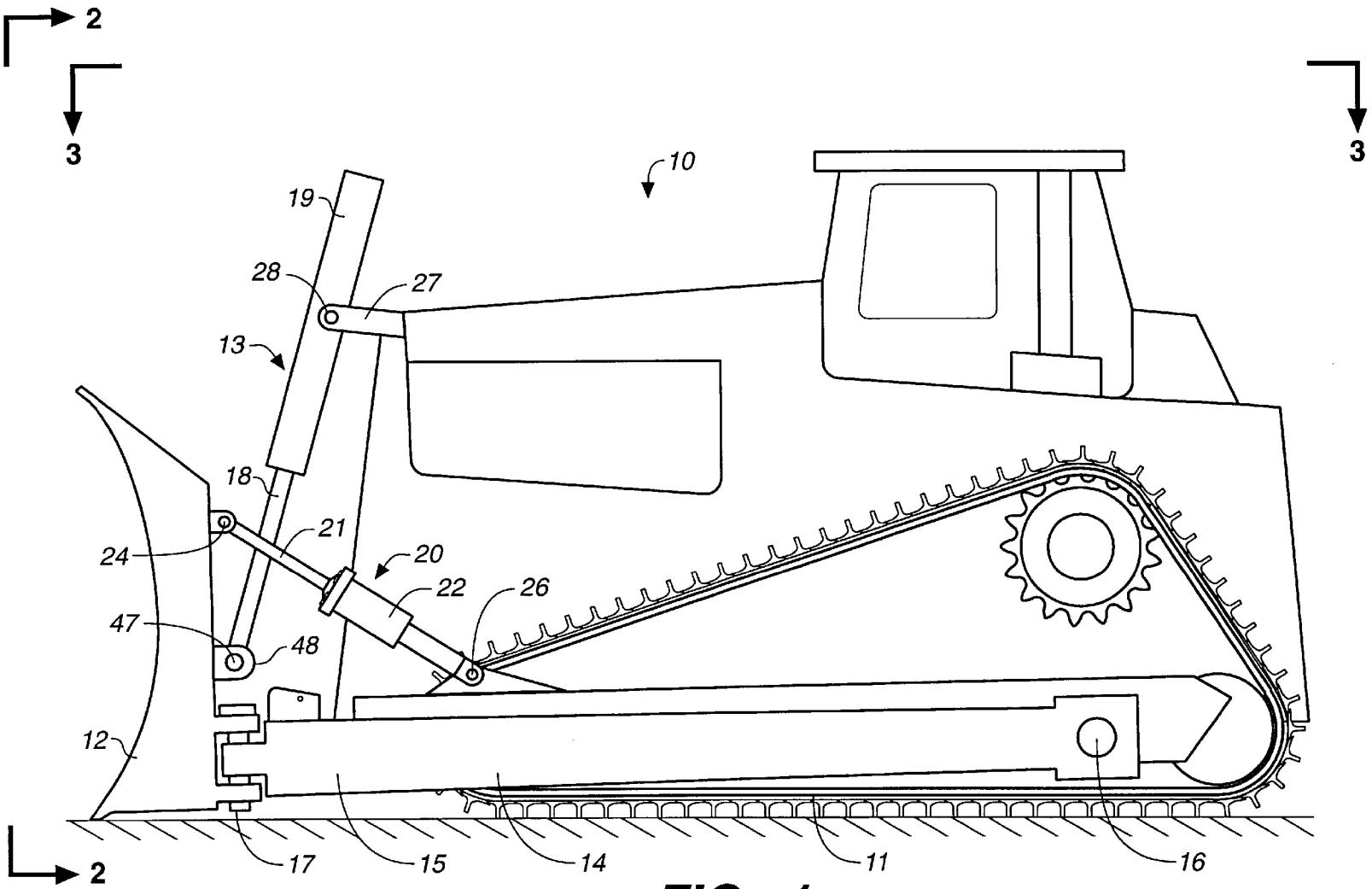
FIG. 1 is a side elevational view of a bulldozer with the blade attached.
Figure 2:
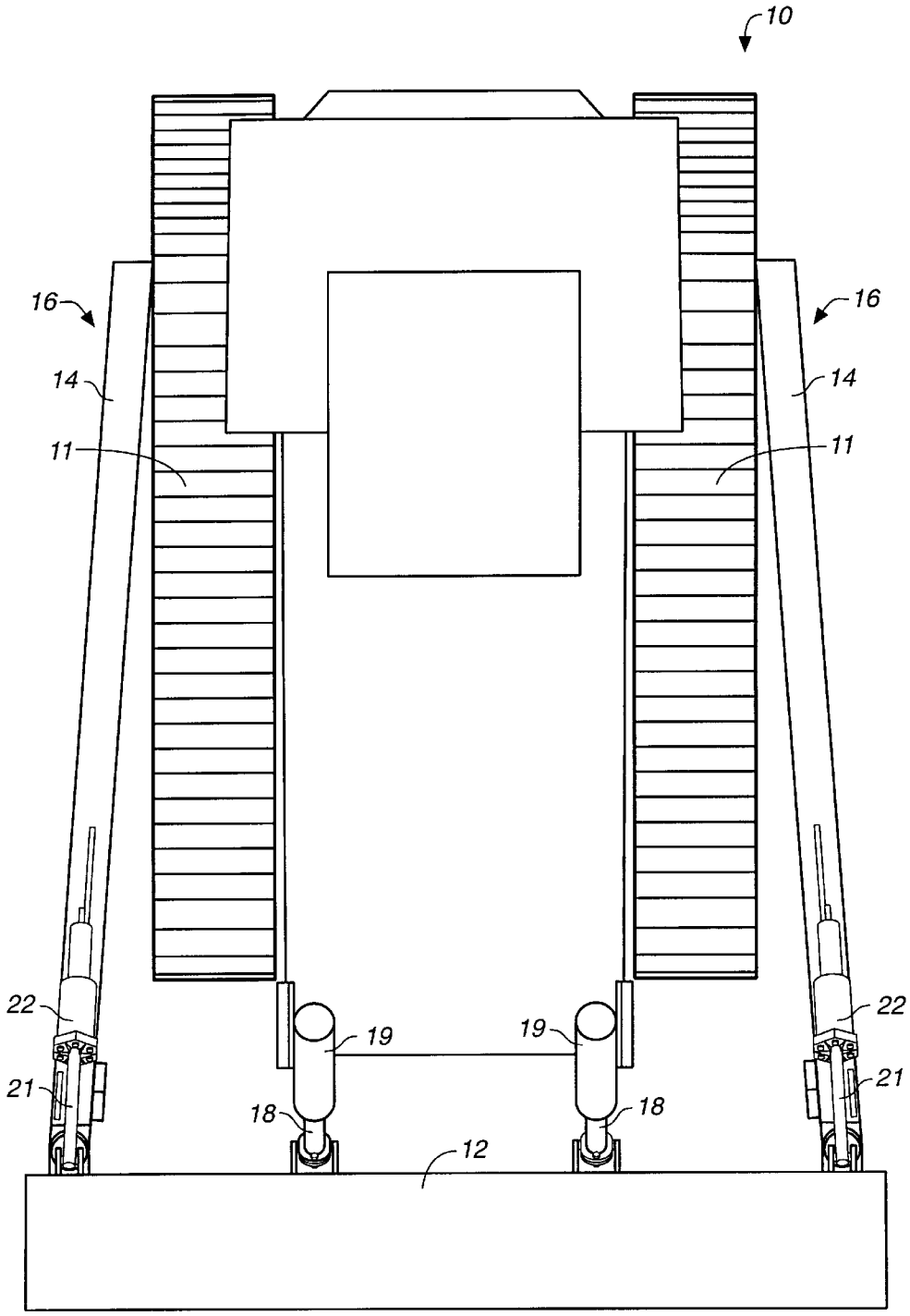
FIG. 2 is a top plan view of the bulldozer of FIG. 1.

As is best shown in FIGS. 1 and 2, bulldozer 10 has a blade 12 which is removably mounted to a pair of push arms 14 which extend on opposite sides of bulldozer 10. Push arms 14 are trunnioned or connected at their rear ends to the body of bulldozer 10 by universal joints 16, and blade 12 is connected to front ends 15 of push arms 14 by a pin 17. Lifting of blade 12 is accomplished by a hydraulic lifting assembly 13, which includes preferably a hydraulic piston rod 18 and cylinder 19. As shown in the drawing, a pair of pistons 18 and cylinders 19 are employed, but it will be understood that a single lift cylinder 19 and piston 18 could be used. Blade 12 also is adapted to be tilted by a tilting assembly 20 which preferably includes a pair of piston rods 21 and cylinders 22.

When bulldozer 10 is to be transported on a low-bed flatbed truck from one worksite to another, blade 12 must be removed as a first step in decreasing the width of the bulldozer, thereby making the bulldozer street legal. Blade 12 is removed by detaching pins 17 connecting blade 12 to push arms 14. In addition, blade lifting and tilting assemblies must also be detached from their connection points at the back of blade 12 and removed from the bulldozer or secured in some manner.

Simply removing blade 12 from the front of the bulldozer will, in the absence of using the present invention, result in a situation where the front ends 15 of push arms 14 will simply rest upon the ground in the same outwardly splayed orientation which they assume when bade 12 is attached thereto. Having front ends 15 of push arms 14 simply resting upon the ground makes it impossible to drive the bulldozer on and off a flatbed truck for transportation between various worksites, and causes a great potential for interference between push arms 14 and tracks 11 when attempting to drive or turn the bulldozer with blade 12 removed. Thus, conventionally, the push arms must be removed.

Yet another problem occurs when detaching piston rods 18 from blade 12. The respective hydraulic assemblies must be secured or removed from the bulldozer. When this occurs, hydraulic seals can be broken and hydraulic fluid lost. The potential for the same problems also occurs with regard to tilting hydraulic assemblies 20. As is best shown in FIG. 1, piston rod 21, when attached to blade 12, is supported in an upwardly angled orientation with a pivotal connection point 24 between piston rod 21 and blade 12 being positioned above the pivotal connection point 26 between cylinder 22 and push arm 14. When detached from blade 12, piston rod 21 and cylinder 22 are free to rotate to a downwardly inclined orientation.

The present invention overcomes all the above limitations and offers many additional advantages as follows.

Figure 3:
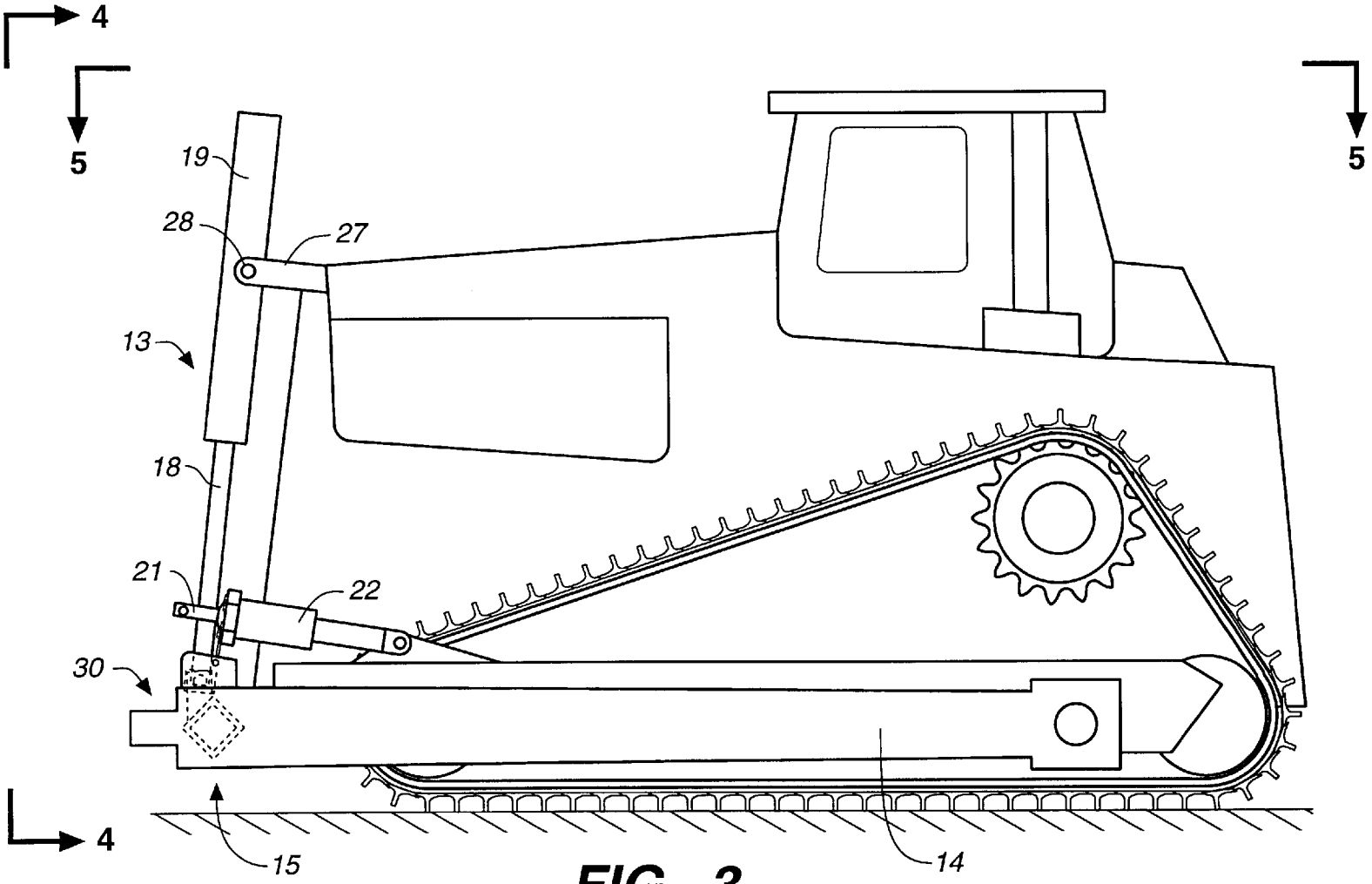
FIG. 3 is a side elevation view of the bulldozer of FIG. 1 with the blade removed and a push arm control assembly constructed in accordance with the present invention attached thereto.
Figure 4:
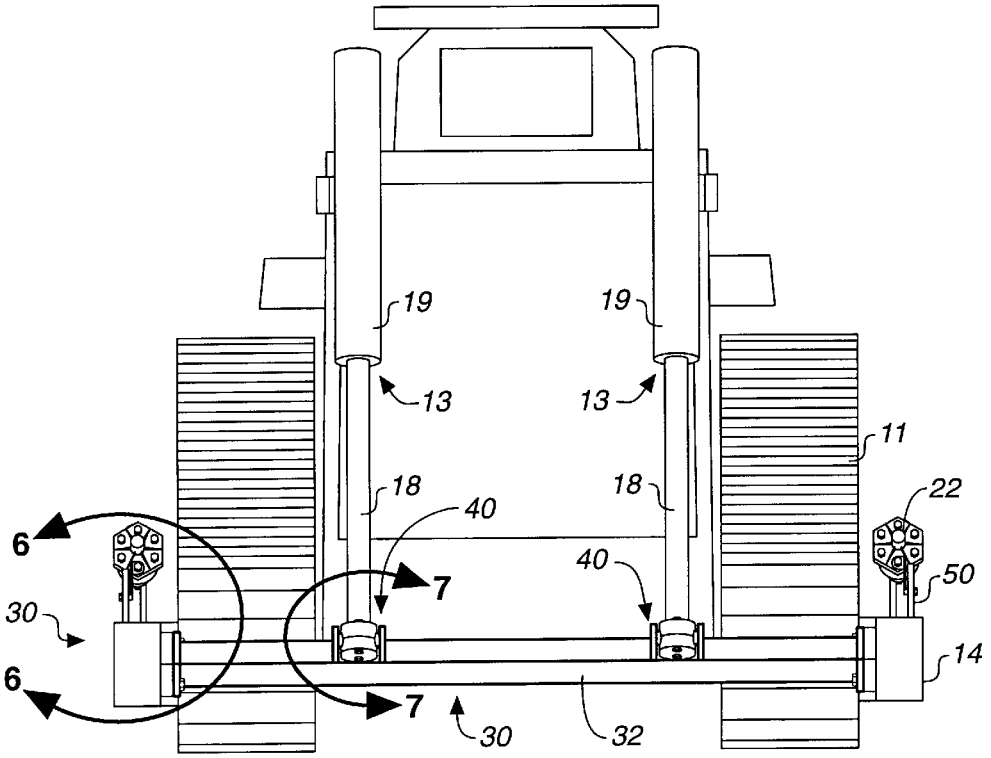
FIG. 4 is a front elevation view of the bulldozer of FIG. 3.
Figure 6:
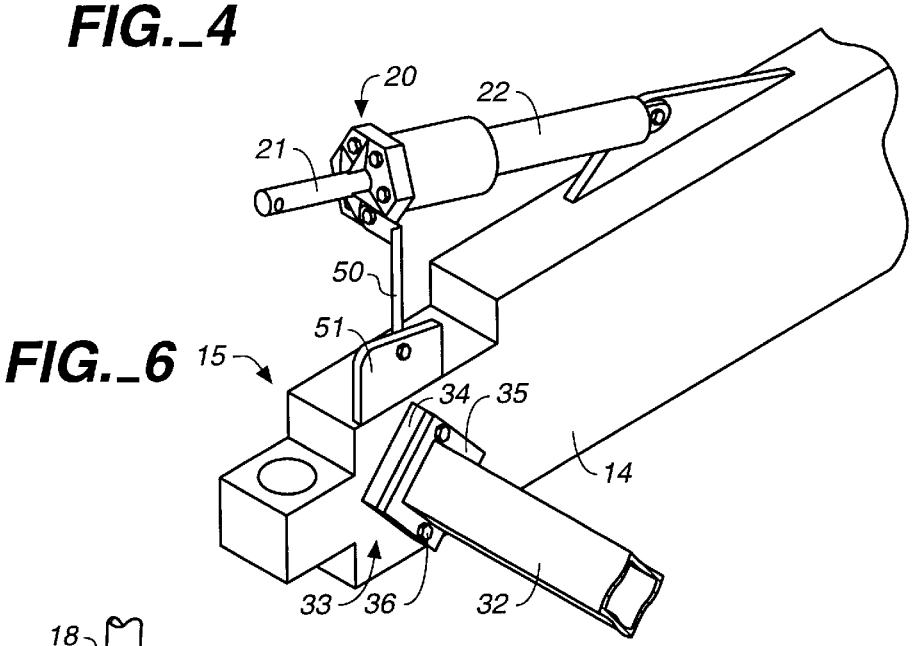
FIG. 6 is an enlarged, fragmentary, top perspective view of the push arm control assembly attached to a bulldozer push arm, in the area bounded by line 6—6 of FIG. 4.
Figure 5:
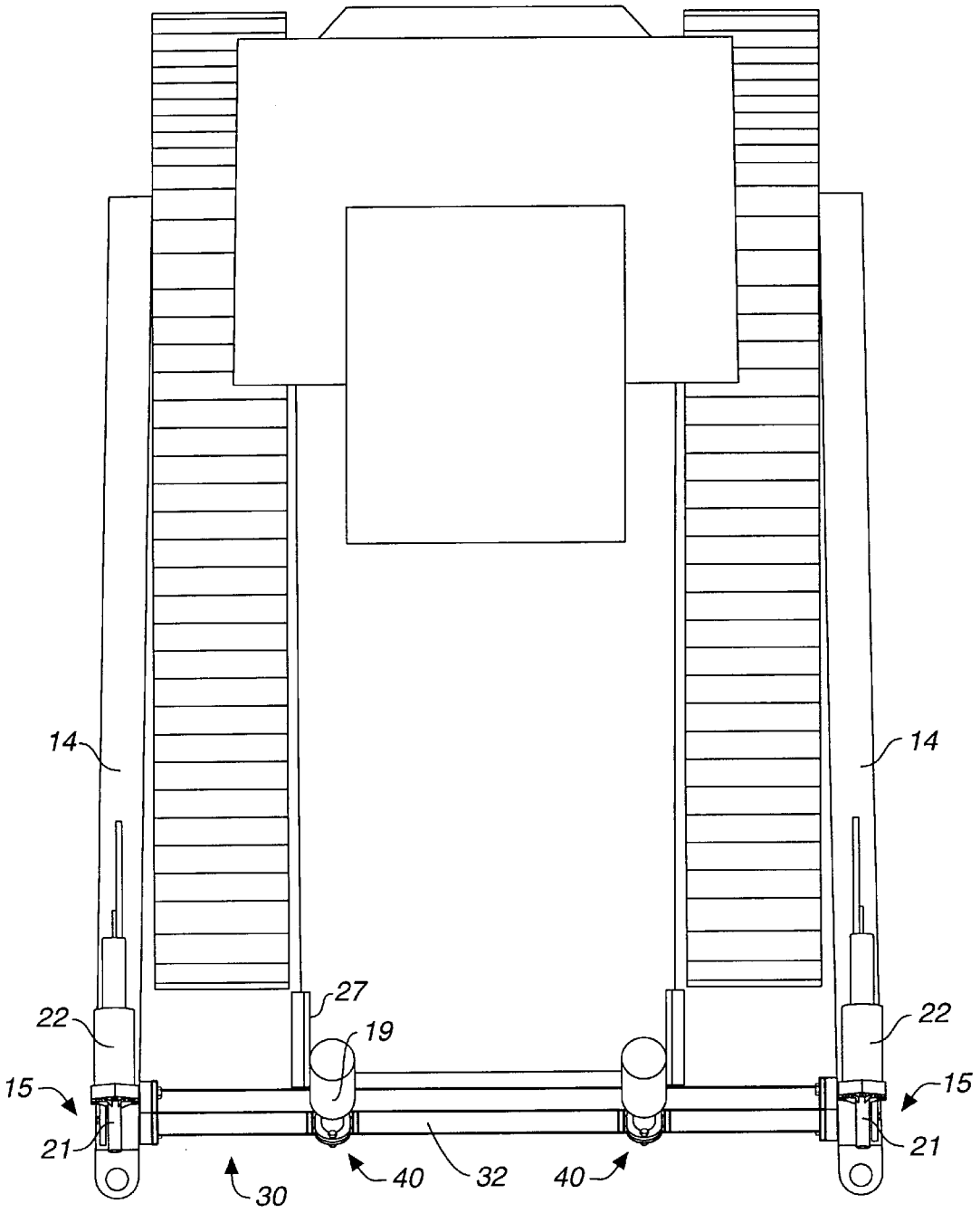
FIG. 5 is a top plan view of the bulldozer of FIG. 3.

A push arm control assembly, generally designated 30, best shown in FIGS. 3, 4 and 5 is provided for attachment to the front of bulldozer 10 after blade 12 has been removed. Push arm control assembly 30 preferably comprises a control member 32 which, in a first embodiment, as is shown in FIGS. 4 and 5, comprises at least one removable elongated steel bar or rod, which has a length dimension substantially spanning the distance between push arms 14. As is shown in FIG. 6, control bar 32 is a hollow member having a rectangular cross section, and the control bar is attached to push arm 14 by a coupling assembly 33. Coupling assembly 33 preferably is comprised of a first coupling member 34, typically being a block or plate of steel which is welded directly onto the inside of each of push arms 14, a second coupling member 35, typically being a flange or plate mounted (for example, by welding) on the end of control bar 32, and a plurality of fasteners 36, typically being a set of bolts formed to releasably secure coupling member 34 to coupling member 35. Accordingly, control bar 32 is bolted or screw fastened together with push arms 14 using coupling assembly 33.

Control bar 32, in its first embodiment, is designed with a length dimension somewhat less than the normal separation distance between front ends 15 of push arms 14 when push arms 14 are in their normal outwardly splayed position for attachment to blade 12 (best shown in FIG. 2). Since push arms 14 are connected or trunnioned to bulldozer 10 by universal joints 16, front ends 15 of push arms 14 can easily be displaced or rotated inwardly once the blade is removed. Such inward displacement of the push arms enables connection to the opposite ends of control bar 32 by coupling assemblies 33. Inward displacement of push arms 14 also ensures that the overall width of the bulldozer assembly is decreased, as is shown in FIG. 5, to the point that the bulldozer will be street legal. Moreover, the length dimension of control bar 32 is selected to hold front ends 15 of push arms 14 immediately proximate, but out of contact with, tracks 11 such that they do not interfere with the movement of the tracks of the bulldozer. This facilitates driving of the bulldozer onto the transport truck when the bulldozer blade has been removed.

An additional advantage of connecting front ends 15 of push arms 14 to control bar 32 is that the motion of one push arm is restrained relative to the motion of another when the blade of the bulldozer has been removed. Thus, in the broadest aspect of the present invention, the two push arms 14 are coupled together as a unit for controlled positioning to enable the bulldozer to be transported while the push arms are still attached to the bulldozer.

Figure 7:
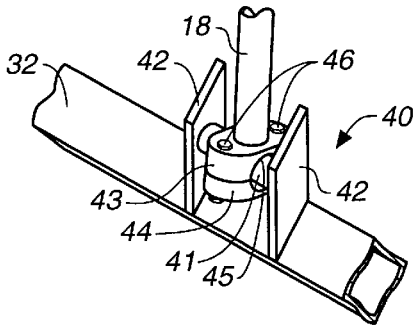
FIG. 7 shows a fragmentary, top perspective view of the attachment of the push arm control assembly to a piston of a hydraulic lift cylinder, in the area bounded by line 7—7 of FIG. 4.

A pair of lift coupling assembles 40, best shown in FIGS. 4 and 7, are provided on control bar 32 to couple the control bar to the lower ends of piston rods 18 of lift assembly 13. Referring to FIG. 7, lift coupling assembles 40 comprise a pin 41 secured between support ears or flanges 42, which are welded or otherwise secured to bar 32.

The ends of piston 18 are provided with a first coupling member 43 and a second coupling member 44, which together define a bore 45 dimensioned to receive pin 41 and a similar pin 47 provided with ear structure 48 on bulldozer blade 12. Pistons 18 are detached from blade 12 by removing bolts 46, and second coupling member 44, and the pistons are attached to bar 32 by securing member 44 back to member 43 around pin 41 using bolts 46.

By operating lifting assembly 13, control bar 32 can be selectively raised and lowered, for controlled vertical positioning of push arms 14 when the blade is removed. Since cylinder 19 is coupled to bulldozer bracket arm 27 by a transversely oriented pin 28 and piston 18 is coupled to control bar 32 by a transversely extending pin 41, the piston cylinder assemblies 13 are not free to move from side-to-side. Thus, once the inwardly rotated push arms are secured to control bar 32 and the control bar coupled to hydraulic assemblies 13, push arms 14 are held in parallel but spaced relation to tracks 11 by hydraulic assemblies 13. Thus, the inwardly displaced front ends 15 of push arms 14 can be lifted off the ground as desired. During the raising and lowering of control bar 32, the lower end of piston rod 18 is free to rotate around pin 41 and cylinder 19 is free to rotate about pin 28 when control bar 32 and push arms 14 are raised or lowered.

An important advantage of such a design is the ease with which bulldozer 10 can be driven on and off a flatbed truck with push arms 14 still attached to the bulldozer. As will be understood, it also would be possible to raise the push arms with a crane and chain control bar assembly 30 to the bulldozer in a raised position. An important additional advantage of connecting the lower ends of each piston rod 18 to lift coupling assemblies 40, however, is that hydraulic assemblies 13 are secured and do not have to be removed from the bulldozer. For additional safety, it is also possible to provide safety chains, not shown, which can be attached between the bulldozer and the push arms to catch the push arms should the lift assemblies 13 fail.

With regard to the problem of tilt assemblies 20, the present invention avoids the need to remove these assemblies as follows. As is best shown in FIG. 6, an upright support arm or bar 50 is provided which is attached at a lower end to push arm 14 and at the upper end to cylinder 22 of tilt assembly 20. Support bar 50 attaches to front end 15 of push arm 14 by way of attachment plate 51 when piston rod 21 has been detached from the back of the blade. In this manner, support bar 50 acts to slightly upwardly incline cylinder 22 of tilt assembly 20 thus securing the assembly and preventing piston rod 21 from gravitating outwardly from cylinder 22.

Figure 8A:
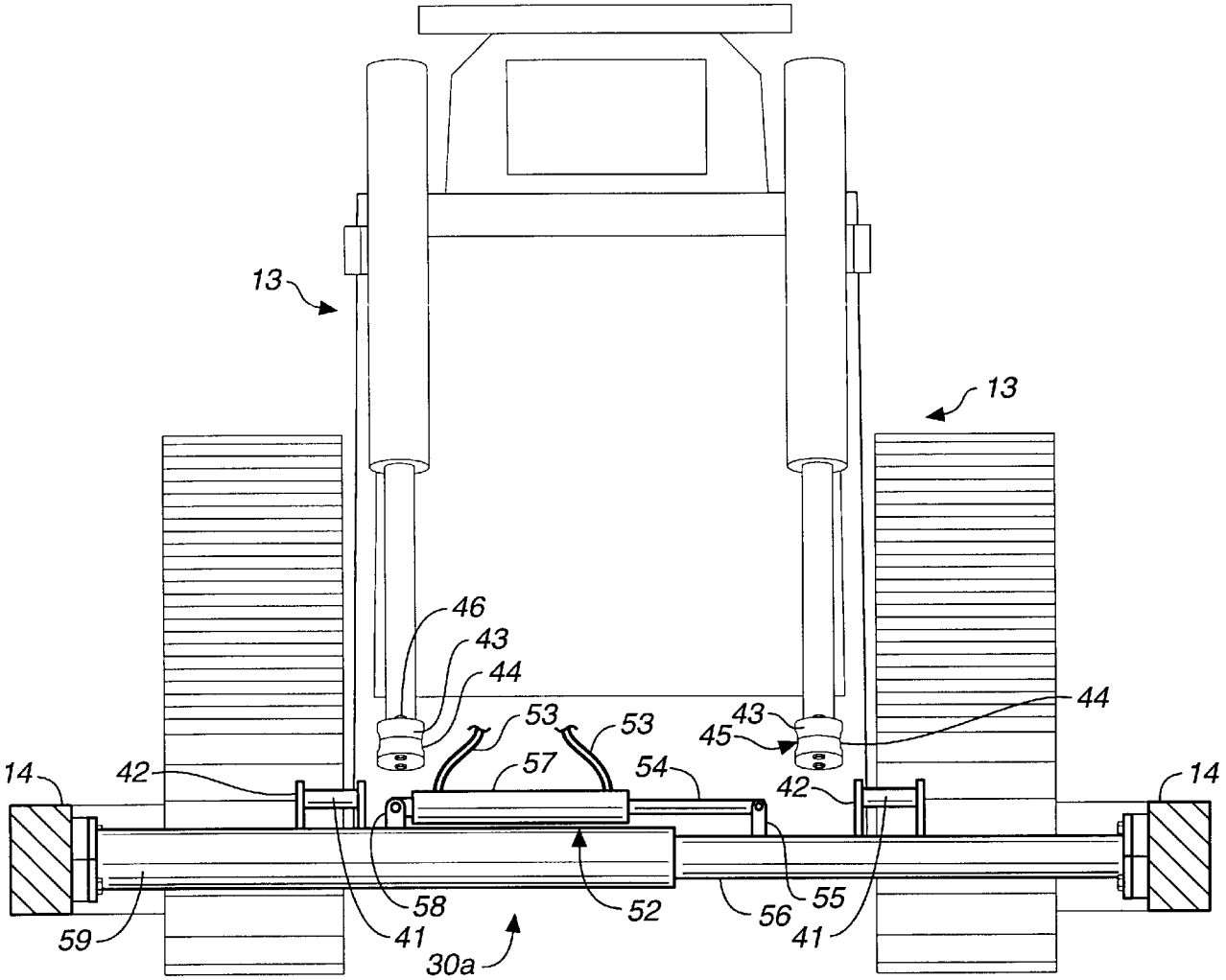
FIG. 8A is a front elevation view of the bulldozer of FIG. 3 with the front blade removed showing an alternative embodiment of the push arm control prior to attachment to the bulldozer hydraulic lift cylinders.
Figure 8B:
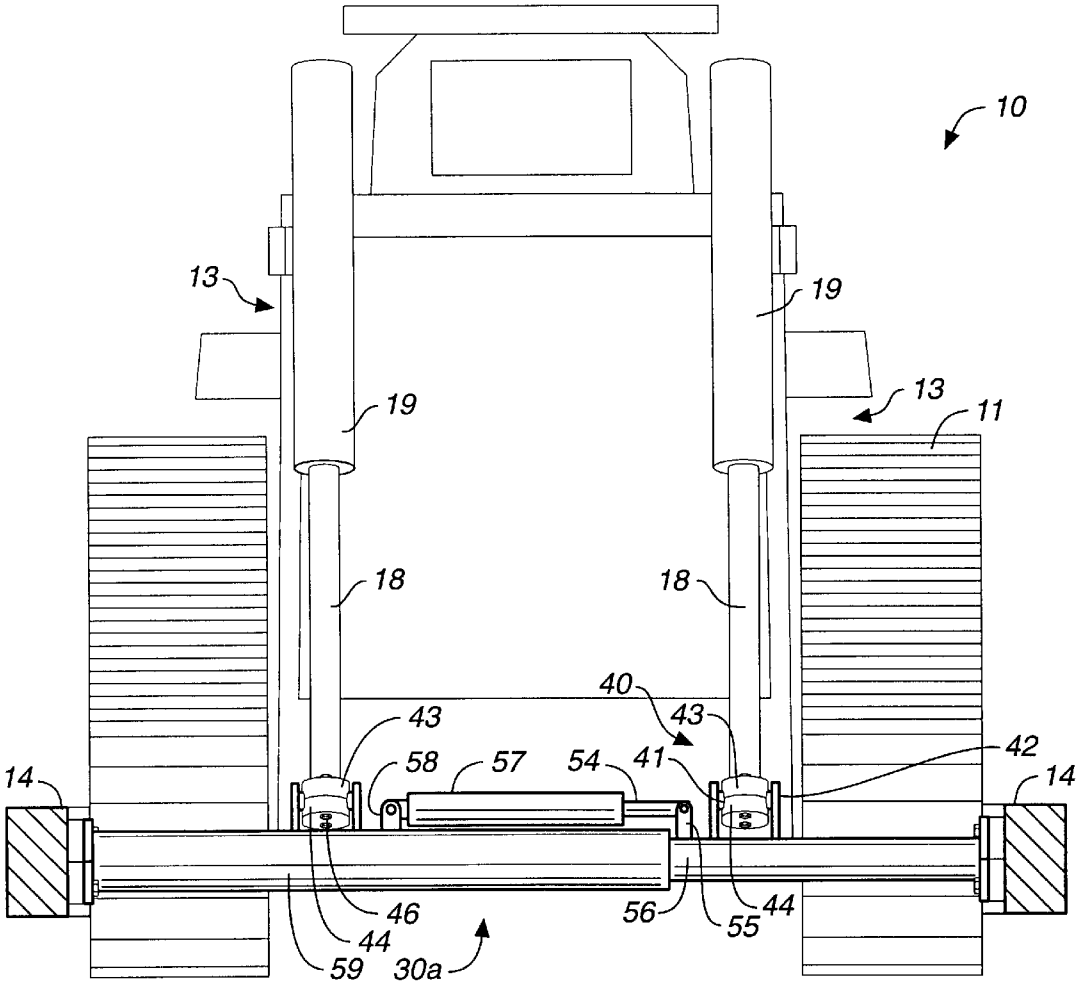
FIG. 8B is a front elevation view corresponding to FIG. 8A showing the push arm control assembly retracted and attached to the hydraulic lift cylinders.

In a second embodiment, as shown in FIGS. 8A and 8B, a telescoping control bar assembly 30*a* is provided that can be extended and retracted such that, at its fully retracted position (FIG. 8B), telescoping control bar assembly 30*a* supports push arms 14 at the same inwardly rotated orientation as was seen in the first embodiment of FIGS. 1–7. The fully retracted length of telescoping control bar assembly 30*a* would typically be set equal to the length of the fixed length control bar of the first embodiment. In this way, when telescoping control bar assembly 30*a* is fully retracted, push arms 14 will be held at an inwardly rotated orientation such that the width of the bulldozer is reduced to be street legal, but also so that push arms 14 are not inwardly displaced so as to interfere with the movement of tracks 11 of the bulldozer.

Telescoping control bar assembly 30*a* preferably has an extended length such that, when fully extended (FIG. 8A), push arms 14 are laterally spaced apart by a distance substantially equal to the lateral distance required to couple push arms 14 to blade 12. This enables control bar 30*a* to remain mounted to push arms 14 when blade 12 is attached to the push arms. Control bar 30, by contrast must be removed from the push arms in order to outwardly displace the push arms for attachment of blade 12.

As is seen in FIGS. 8A and 8B, a push arm displacement piston rod and cylinder assembly 52 is provided with hydraulic fluid lines 53 which can be fluid coupled to the bulldozer's hydraulic system.

Piston 54 is connected by ear 55 to one of two telescoped bar members 56, while cylinder 57 is coupled through ear 58 to the other bar member 59. Telescoping displacement is used to controllably adjust the relative lateral displacement between front ends 15 of push arms 14 such that the width of bulldozer 10 can be easily narrowed to a street legal size after the removal of blade 12.

As will be seen from FIG. 8B, in the fully retracted position, coupling members 43 and 44, which have been uncoupled from blade 12, can be attached to pins 41 and ears 42 on the telescoping bar members 56 and 59. Once coupled to control bar assembly 30*a*, hydraulic lift cylinders 19 can be used to lift and control the vertical positioning of push arms 14. While the embodiment of FIGS. 8A and 8B is not intended to have coupling members 43 and 44 attached to telescoping bar 30*a* during operation of the bulldozer, it will be understood that such a construction could be employed within the scope of the present invention if the telescoping bar assembly 30*a* were strong enough. As noted, push arms 14 can weigh 5000 pounds or more and blade 12 can weigh 10,000 pounds or more. In the bar assembly of FIGS. 8A and 8B, the bar member 56 preferably extends inside tubular bar member 59 as far possible while still permitting retraction to the position of FIG. 8A. This construction readily provides an assembly with sufficient strength to lift push arms 14 for transport.

If hydraulic assemblies 13 are to be used to lift blade 12, as well as push arms 14, through the control bar 30 during normal operation of the bulldozer, the control bar assembly should be constructed of an even stronger construction. Thus, telescoping bar assembly 30*a* might be larger in diameter and wall thickness or a plurality of transversely extending, telescoping bar assemblies could be employed.

Having described the preferred apparatus of the invention, the method can now be set forth.

The present invention provides a method of enabling transport of a bulldozer 10 having at least two push arms 14 which are detachably connected to a bulldozer blade 12. The present method repositions and restrains push arms 14 against undesired movement during transportation of bulldozer 10 and is comprised of the steps of: (a) detaching bulldozer blade 12 from bulldozer 10, (b) mounting push arm control assembly 30 between push arms 14, and (c) lifting control assembly 30, 30*a* to a position enabling bulldozer 10 to be driven onto a truck. Most preferably, the lifting step is accomplished using the hydraulic piston and cylinder assembly 13 used to lift bulldozer blade 12, but control bar 30, 30*a* also could be lifted using a crane and simply secured in place through the use of a chain extending between the bulldozer body and the control bar assembly.

The mounting step in the present method is preferably accomplished by inwardly displacing push arms 14 and connecting push arms 14 to control bar assembly 30 at a location on control bar 30 which holds push arms 14 in an inwardly displaced position from that which they otherwise occupy when attached to blade 12. Alternatively, the mounting step can be accomplished prior to the lifting step by mounting a telescoping control bar assembly 30*a* to the push arms. When a telescoping bar assembly 30*a* is employed, the present method further includes the step of retractably telescoping the telescoping control assembly 30*a* from its extended position to a retracted position, thereby inwardly displacing push arms 14 toward each other. Once retracted, the bulldozer blade lifting assemblies 13 can be attached to control bar assembly 30*a* and used to lift control bar assembly 30*a* and push arms 14, thereby enabling movement of the bulldozer onto a low-bed flatbed truck.

When detaching blade 12 from the front of the bulldozer, a danger exists that blade 12, when free-standing after its detachment, will tip over onto the operator performing the blade detachment, thus resulting in the potential for serious injury. Accordingly, for reasons of safety, the preferred method of detaching blade 12 is preferably carried out such that blade 12 is first detached from push arms 14 by removing pins 17, and then detached from blade lifting assemblies 13 by removing pin 47 from ear structure 48 and then finally detached from blade tilt assemblies 20 at connection point 24. By detaching blade tilt assemblies 20 last, blade 12 is thus supported at its highest point of connection to the bulldozer, such that the blade is held at a position such that it is prevented from tipping over.

In addition, by detaching lifting assemblies 13 before detaching tilt assemblies 20, the operator performing the blade detachment is then positioned beside the end of the blade, rather than between the blade and the bulldozer, when the blade is finally detached, thus being out of its way should it tip over. In contrast, should the order of detachment be altered such that the operator detaches tilting assemblies 20 before lifting assemblies 13, the operator performing the detachment will be positioned between the blade and the bulldozer at the moment when the blade is detached from the bulldozer.

For additional safety, blocks of wood can be positioned at the front and back of the blade as it is detached from the bulldozer to assist in preventing the blade from tipping over.

What is claimed is:

1. In combination a push arm control assembly and a bulldozer comprising:

a bulldozer having a pair of laterally displaceable push arms on opposite of the bulldozer outwardly of a pair of bulldozer tracks formed for releasable coupling to a bulldozer blade, and a lifting assembly formed to lift said push arms said blade; and a control assembly having at least one elongated, push arm control member having a length dimension less than the lateral distance between the push arms when said push arms are coupled to said blade for use of said blade, and having a length dimension spanning the distance between said push arms when said blade is removed and said push arms are displaced laterally inwardly to position the front ends of said push arms immediately proximate but out of contact with said tracks of said bulldozer, and said control member having a strength sufficient to enable lifting of both of said push arms using said control member;

a pair of arm coupling assemblies provided on one of said control member and the arms, said coupling assemblies removable coupling said control member and the push arms together; and said lifting assembly being coupled to said control member for lifting and controlled positioning of said push arms as a unit using said control member for transport of said bulldozer with said blade removed and said push arms attached to said control member.

2. In combination a push arm control assembly and bulldozer comprising:

a bulldozer having pair of push arms on opposite sides of the bulldozer outwardly of a pair of bulldozer tracks formed for releasable coupling of a bulldozer blade thereto, and a lifting device provided on said bulldozer and formed for releasable coupling to said push arms; and a control assembly including at least one elongated bar having a length dimension less than the distance between said push arms when said blade is attached to said push arms and a length dimension spanning the distance between the push arms when said blade is removed from said push arms and said push arms are immediately proximate but out of contact with the tracks of the bulldozer, and the bar having a strength sufficient to enable lifting of both of said push arms using said bar;

a pair of arm coupling assemblies provided proximate opposite ends of said bar removably coupling each of said push arms to said bar; and at least one lift coupling assembly provided on said bar releasably coupled to said lifting device to enable lifting of said push arms by said bar for lifting and controlled positioning of said push arms as a unit when said blade is removed therefrom.

3. A push arm control assembly for use with a bulldozer having a blade removably mounted to a pair of laterally displaceable push arms on opposite sides of the bulldozer, said control assembly comprising:

a pair of elongated control members having ends mounted in relative telescoped relation for slidable displacement to provide an adjustable combined length dimension between opposite ends of said control members, and having a strength sufficient to enable lifting of the push arms as a unit;

an arm coupling assembly provided proximate said opposite ends of said telescoping control members and adapted for coupling to each of the push arms, said arm coupling assemblies being laterally displaceable between an extended position in which the push arms are coupled to the blade and a retracted position at which the push arms are inwardly displaced toward the bulldozer by an amount sufficient for lifting and controlled positioning of the push arms for transport when the blade is removed; and a telescoping displacement actuator coupled between said control members for powered displacement of said control members between the extended position and the retracted position.

4. The push arm control assembly as defined in claim 3 wherein, said telescoping displacement actuator is a hydraulic piston and cylinder assembly.

5. The push arm control assembly as defined in claim 3, and a lift coupling assembly provided on at least one of said control members and adapted for coupling to a lifting device carried by the bulldozer and used to lift the blade and push arms.

6. A method of enabling transport of a bulldozer having a bulldozer blade removed therefrom, said bulldozer having at least two push arms adapted for connection to said bulldozer blade, said push arms being restrained against undesired movement comprising the steps of:

a) detaching said bulldozer blade from said bulldozer;

b) mounting a control assembly between said push arms for movement of said push arms as a unit; and c) lifting one of said push arms and said control assembly to lift said push arms as a unit and thereby enabling movement of said bulldozer onto a transport vehicle.

7. The method of enabling transport of a bulldozer having a bulldozer blade removed therefrom, as set out in claim 6 wherein, said bulldozer has tracks on opposite sides thereof; and during said mounting step inwardly displacing said push arms to a position closely proximate and out of engagement with the bulldozer tracks.

8. The method of enabling transport of a bulldozer having a bulldozer blade removed therefrom, as set out in claim 6 wherein, said lifting step is accomplished by coupling said control assembly to a blade lifting piston and cylinder assembly carried by said bulldozer, and using said blade lifting piston and cylinder assembly to lift said control assembly and said push arms.

9. A method of enabling transport of a bulldozer having a bulldozer blade removed therefrom, said bulldozer having at least two push arms adapted for connection to said bulldozer blade, said push arms being restrained against undesired movement comprising the steps of:

a) detaching said bulldozer blade from said bulldozer;

b) coupling a telescoping control member assembly between said push arms;

c) retracting said telescoping control member assembly from an extended position to a retracted position, thereby inwardly displacing said push arms toward each other; and d) lifting said telescoping control member assembly to lift said push arms thereby enabling movement of said bulldozer onto a transport vehicle.

10. The method of enabling transport of a bulldozer having a bulldozer blade removed therefrom, as set out in claim 9 wherein, said lifting step is accomplished by coupling said telescoping control member assembly to a blade lifting piston and cylinder assembly carried by said bulldozer, and using said blade lifting piston and cylinder assembly to lift said control member assembly and said push arms.

11. A push arm control assembly for use with a bulldozer having a blade removably mounted to a pair of laterally displaceable push arms on opposite sides of the bulldozer, said control assembly comprising:

two push arm control members having a combined length dimension substantially spanning the distance between the push arms and having a strength sufficient to enable lifting of both of the push arms, said control members being mounted for relative sliding movement and being formed for coupling to the push arms;

a push arm displacement assembly coupled to said control members and constructed and operable to inwardly and outwardly displace said control members and the push arms between a laterally extended position for coupling of the push arms to the blade and a laterally retracted position for coupling of the control members to a lift assembly provided on the bulldozer; and a pair of arm coupling assemblies provided on one of said control members and the push arms, said coupling assemblies being adapted for coupling said control members to the push arms, whereby upon removal of the blade from the push arms, the control member can be coupled to the push arms by the arm coupling assemblies for lifting and controlled lateral positioning of the push arms as a unit for transport of the bulldozer with the blade removed and the push arms attached.

12. The push arm control assembly of claim 11 wherein, said arm displacement assembly is provided by a hydraulic piston and cylinder assembly.

13. In combination, a bulldozer and a push arm control assembly comprising:

a bulldozer having a pair of push arms mounted on opposite sides of said bulldozer, said push arms being adapted for removable mounting of a bulldozer blade thereto and having said blade detached therefrom; and a push arm control assembly having a length dimension substantially spanning the distance between the push arms and having a strength sufficient to enable lifting of the push arms as a unit, said push arm control assembly including two relatively telescoped control members and a lateral displacement assembly operably coupled to laterally displace said control members and said push arms, and said push arm control assembly further including a pair of arm coupling assemblies adapted for and coupled to each of said push arms.

14. The bulldozer and push arm control assembly of claim 13 wherein, said lateral displacement assembly is provided by a piston and cylinder assembly.

* * * * *